US008938185B1

(12) United States Patent
Spitz

(10) Patent No.: US 8,938,185 B1
(45) Date of Patent: Jan. 20, 2015

(54) NON-DETACHABLE COVER AND SLOTTED HINGE ASSEMBLY

(75) Inventor: Glenn S. Spitz, Boulder, CO (US)

(73) Assignee: Webscan, Inc., Longmont, CO (US)

( * ) Notice: Subject to any disclaimer, the term of this patent is extended or adjusted under 35 U.S.C. 154(b) by 220 days.

(21) Appl. No.: 13/553,274

(22) Filed: Jul. 19, 2012

(51) Int. Cl.
*G03G 15/00* (2006.01)

(52) U.S. Cl.
USPC ..... 399/110; 399/107; 399/380; 16/68; 16/227

(58) Field of Classification Search
USPC ..... 399/107, 110, 379, 380; 16/38, 277, 16/345
See application file for complete search history.

(56) References Cited

U.S. PATENT DOCUMENTS 5,812,285 A 9/1998 Lin et al.
6,363,576 B1 4/2002 Hsu et al.
7,429,039 B2 * 9/2008 Hattori et al. ..... 271/10.01
7,619,789 B2 * 11/2009 Kurokawa et al. ..... 358/497
7,747,208 B2 * 6/2010 Sheng et al. ..... 399/380
7,949,292 B2 * 5/2011 Choi ..... 399/380
2002/0164197 A1 11/2002 Lee
2004/0174515 A1 9/2004 Votipka et al.
2004/0228082 A1 11/2004 Tiao
2004/0234311 A1 * 11/2004 Adams ..... 399/380

* cited by examiner

*Primary Examiner* — Francis Gray
(74) *Attorney, Agent, or Firm* — Island Patent; F. Scott Tierno

(57) ABSTRACT

An imaging window cover and slotted hinge assembly includes a cover and first hinge members rotatably and slideably coupled to second hinge members. The cover and slotted hinge assembly enables the cover to be attached to a housing so that the cover may be located in any position between a fully covering position and a rotated and stowed position. When rotated and stowed, the cover and hinge assembly are fully located below a plane of the imaging window, and fully out of the way so that large objects may be placed over the imaging window. This abstract is provided to comply with rules requiring abstracts, and is submitted with the intention that it will not be used to interpret or limit the scope and meaning of the claims.

13 Claims, 8 Drawing Sheets

NON-DETACHABLE COVER AND SLOTTED HINGE ASSEMBLY

TECHNICAL FIELD

The presently disclosed invention relates most generally to cover and hinge assemblies. More particularly, the present invention relates to embodiments of a versatile cover and slotted hinge assembly that supports imaging activities for the purpose of copying or scanning printed matter, which may include encoded data carrying graphical symbols, affixed to items having a range of thicknesses and sizes.

BACKGROUND

When attempting to a provide fully functional imaging system, the thickness of the item or article must be accommodated. Importantly, for a paper thin label to be properly imaged the label must be held down flat upon an imaging window in order to achieve high quality imaging data. For example, high quality imaging data may be useful for providing print quality verification and reporting of items such as 1-dimensional and 2-dimensional data carrying symbols.

Therefore, it would be most desirable to provide a simple and multi-function cover and hinge structure, for use with an imaging apparatus, in order to accommodate items ranging from thin, to thick, to oversized, while both maximizing flatness of imaged surfaces and minimizing glare from ambient lighting sources. Also, while accommodating thick and oversized items, it would be most desirable if a cover is provided having a sufficient weight, as items that are quite thin and prone to wrinkling may be very readily imaged, with a minimum of glare from ambient lighting sources.

As will be described hereinafter, the present invention is intended to provide one type of solution, in the form of an improved and versatile imaging window cover and slotted hinge assembly. Further, it would be most desirable to provide such an imaging window cover and hinge structure that permits the cover to remain fully attached to the imaging apparatus housing to which is it affixed, while being able to be placed in a range of positions, including a 'fully covering position', a 'lifted parallel covering position', a 'partially lifted and partially rotated covering position', or a 'rotated and stowed position'.

A number of other notable characteristics, advantages, and or associated novel features of the present invention will become clear from the description and figures provided herein. Attention is called to the fact, however, that the drawings are illustrative only. In particular, the embodiments included and described, have been chosen in order to best explain the principles, features, and characteristics of the invention, and its practical application, to thereby enable skilled persons to best utilize the invention and a wide variety of embodiments providable that are based on these principles, features, and characteristics. Accordingly, all equivalent variations possible are contemplated as being part of the invention, limited only by the scope of the appended claims.

SUMMARY OF PREFERRED EMBODIMENTS

In accordance with the present invention, a versatile cover and slotted hinge assembly is provided for use "covering" an imaging window of a housing of an imaging apparatus. The cover and slotted hinge assembly preferably includes a cover portion having a plurality of spaced first hinge members coupled thereto. An included plurality of aligned second hinge members are arranged to be fixedly coupled to a vertical wall of the housing of the imaging apparatus, while also rotatably and slideably coupled to the first hinge members. In preferred embodiments of the invention the cover and slotted hinge assembly, which are virtually all portions (except the hinge pin), may be manufactured using a monolithic piece of sheet material, which is cut, bent, and otherwise processed, to produce the cover, first hinge members, and second hinge members.

A most preferred first hinge portion would be comprised of an extending first portion, which is rigidly and fixedly extending from a second edge of the cover (so as to extend outwardly from the second edge). A slotted second portion of the first hinge member is coupled to a distal end of the extending first portion. The slotted second portion may preferably be arranged for extending from the first portion at a substantially orthogonal angle. Other arrangements may certainly be provided for fixedly or rotationally coupling the slotted second portions to their respective extending first portions.

It should be noted that each included second hinge member is preferably structured for fastening to an upper location of a vertical wall of the housing so that the entire second hinge member is positioned at or below a plane established by a windowed possibly top housing surface of the imaging apparatus (which typically includes an imaging window therein). This is important, as it permits the rotatably and slideably coupled first hinge members and the cover fixed or coupled thereto, to be positioned in any position possible between a fully covering position (required for thin flexible items) and a non-covering fully rotated and stowed position (useful with large and or oversized items). When in the fully rotated and stowed position, the entire cover and all portions of the slotted hinge assembly are located fully out of the way, at or below a plane of the windowed housing surface (or equivalently, the imaging window of the housing). As such, a relatively large package, even one larger than the housing, may be placed upon the top windowed housing surface, over the imaging window (for imaging purposes), without contacting the cover or hinge structures. As such, the cover and slotted hinge assembly do not have to be detached and separated from the imaging apparatus housing to support the imaging of large objects.

When considering a possibly most preferred embodiment of the present cover and slotted hinge assembly, the cover and each of the included first hinge members may be formed of a monolithic piece of sheet material, with the second hinge members also manufactured from pieces of same sheet material (and thus causing all portions to have a common thickness).

BRIEF DESCRIPTION OF THE DRAWINGS

In the drawings, like elements are assigned like reference numerals. The drawings are not necessarily to scale, with the emphasis instead placed upon the principles and features of the present invention. Additionally, each of the embodiments depicted are but one of a number of possible arrangements utilizing the fundamental components and concepts of the present invention. The drawings are briefly described as follows.

PARTIAL LIST OF REFERENCE NUMERALS

Figure 1:
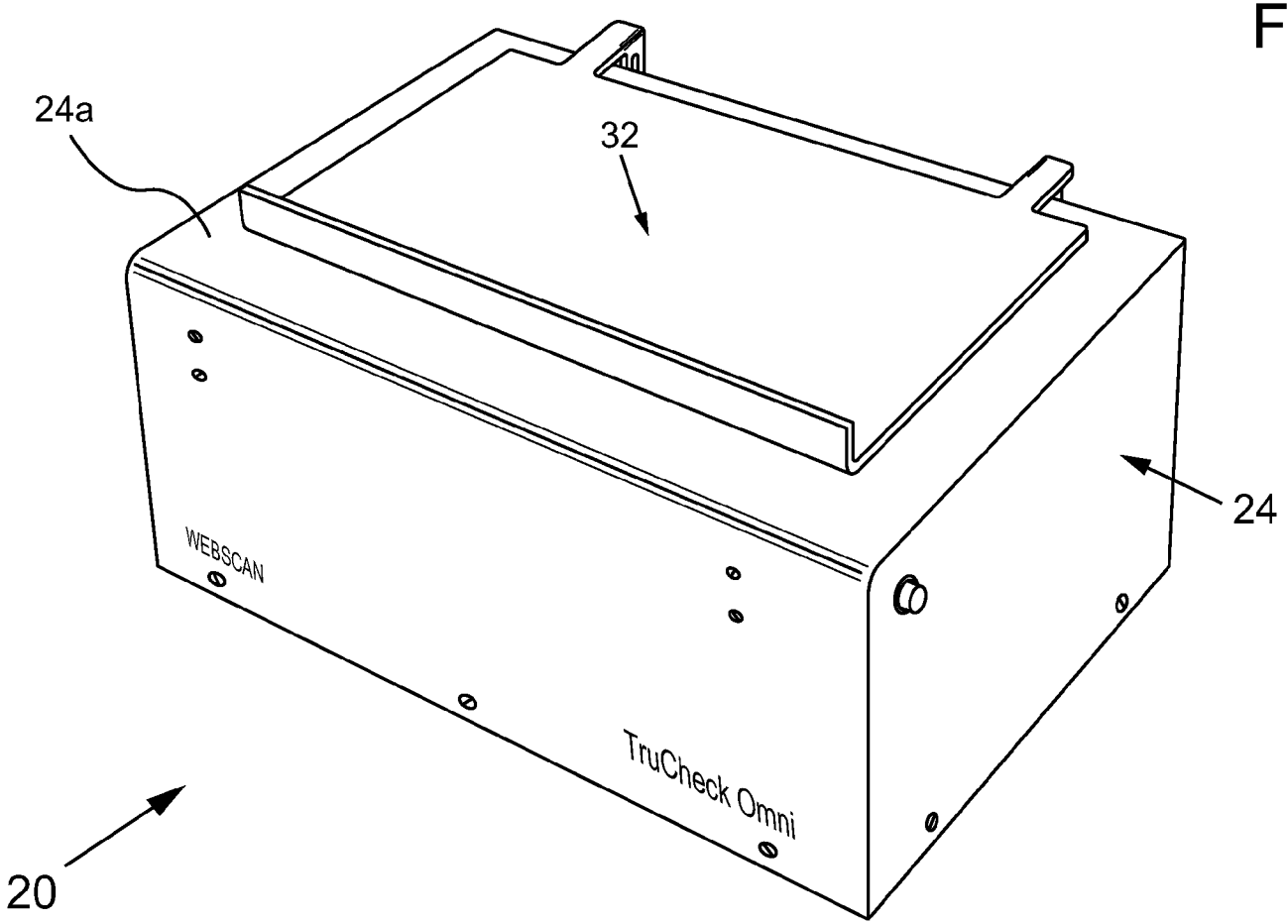
FIG. 1 depicts one possible housing of one possible imaging apparatus with which a cover and slotted hinge assembly of the invention may be employed for covering an imaging window, which as depicted is currently fully covered by the planar cover depicted.

20—imaging apparatus
24—Housing
24*a*—imaging window surface (of 24)
24*b*—vertical wall (of 24)
26—imaging window
28—plane (of 24*a*/26)
30—cover and slotted hinge assembly
32—Cover
32*a*—first edge (of 32)
32*b*—second edge (of 32)
34—slotted hinge assembly
40—first hinge member
42—extending first portion (of 40)
42*a*—first end (of 42)
42*b*—distal end (of 42)
46—slotted second portion (of 40)
46*a*—slot (of 46)
50—second hinge member
52—fixing portion (of 50)
56—coupling portion (of 50)
58—fastener
60—(capped) hinge pin
100—book (side/edge view)
110—Package
A—Angle
L—longitudinal axis
PLH—parallel lift height

DETAILED DESCRIPTION OF EMBODIMENTS OF THE INVENTION

It is important to establish the definition of a number of descriptive terms and expressions that will be used throughout this disclosure. The term 'imaging apparatus' may be considered a broadly defined term and include a variety of systems and apparatus that image or scan items for one or more data capture related reasons. However, it is certainly contemplated that the imaging apparatus could certainly include a variety of possible scanner and or copier units, and most preferably print quality verifier units. As understood by skilled persons, print quality verifier units are used for evaluating the print quality of printed matter typically including data carrying graphical symbols. Common data carrying graphical symbols include 1-dimensional and 2-dimensional bar code symbols. The term 'housing' will be used to broadly describe an outer physical structure of an imaging apparatus that a presently taught cover and slotted hinge assembly may be affixed to. It is contemplated that the housing includes an imaging window, possibly located within a windowed upper or top wall of a housing surface of the apparatus. The inclusion of the cover and hinge assembly enables a versatile and selective covering and uncovering of the imaging window. Importantly, the slotted hinge assembly of the invention enables items of varying thicknesses and shapes to be imaged through the imaging window, while being one of fully covered, at least partially covered, or not covered at all. When the cover is not employed for covering or partial covering, the cover and portions of the slotted hinge assembly may be rotated into what may be termed a 'stowed position' or 'fully stowed position'. When in the stowed position, the entire cover and all hinge portions are located below a plane established by the surface of the imaging window. As will be discussed and claimed herein, the most preferred embodiments of the invention call for a full-time coupling of the cover and slotted hinge assembly to the housing, prohibiting a separating of the cover from the housing, unless purposefully removed (say by undoing fasteners).

Continuing, the expressions 'printed matter', 'encoded graphical information', 'data carrying graphical symbol' are to be understood to include any of a large variety of well known and or possible graphical, data-encoding, visual and readable symbols, such as 1-dimensional and 2-dimensional barcode symbols. Regardless of the actual printed matter of interest, a face (surface) upon which the printed matter is placed or otherwise located, must be imaged through the imaging window of a housing of the imaging apparatus.

Continuing, the term 'substantially' will be employed as a modifier to indicate either exactly or statistically close to the given feature, structure, or characteristic. For example, the phrase 'substantially parallel' may indicate that several items/articles are exactly parallel, or say within +/−5 percent of being truly parallel. In like fashion, the expression 'substantially orthogonal' may be assumed to indicate that the relative alignment of the two items is at exactly a 90 degree angle, or say within +/−5 degrees of being truly orthogonal. Importantly, the terms 'couple', 'coupled to', 'coupling', and the like, are to be understood to mean that two or more described items or limitations are either directly connected together, or alternately, connected to each other via one or more additional, possibly implied or inherent structures, components, etc. Other important terms and definitions will be provided, as they are needed, to properly define the present invention and its associated novel characteristics and features. In addition, the terms and expressions employed herein have been selected in an attempt to provide a full, complete, and accurate description of the invention. These terms may very well have equivalents that may be known to skilled individuals, which may be long established in the art. As such, the terminology employed has been carefully chosen and is intended for illustration and completeness of description, and may very well have equivalents that are known in the art, but are not employed here.

Figure 2:
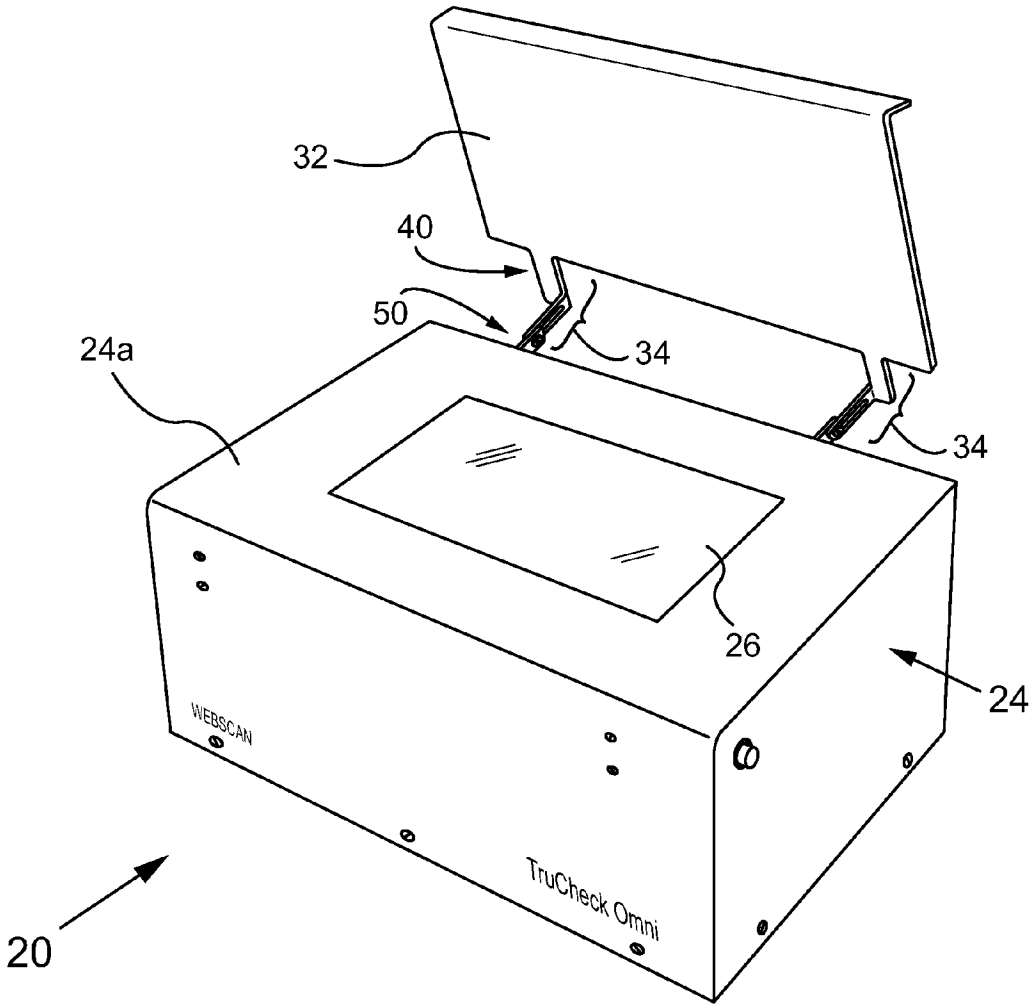
FIG. 2 shows the imaging apparatus of FIG. 1, now with the cover depicted in a lifted and partially rotated position, clearly showing the imaging window of the housing.

Referring now to the drawings, an imaging apparatus 20 is depicted in FIGS. 1 through 3B, as having a housing 24 and a hinged cover 32. As shown in FIG. 1, the cover 32 is depicted in what will be termed a 'fully covering position', wherein the imaging window 26 (as best seen in FIG. 2) is completely covered. The cover 32 is also shown in the fully covering position in FIGS. 3A and 3B. As indicated, preferred covers 32 will be arrange with a first edge 32*a* and a second edge 32*b*. As will be fully discussed hereinafter, hinge structures will extend from the second edge 32*b*, while the first edge 32*a* may be employed for lifting and or rotating the cover 32.

Although the imaging apparatus 20 and housing 24 illustrated in the included figures are generally intended to be depicted as table-top sized items, it should be understood that the actual size of the imaging apparatus 20 may certainly be considerably larger (i.e., scaled up) or smaller (i.e., scaled down) than those depicted.

As shown in FIG. 2, the cover 32 may be lifted and rotated to what may be termed as a 'rotated and lifted position'. As such, the rotational and slotted nature of the slotted hinge assemblies 34 of the invention fully support both a degree of lifting and or a degree of rotating, of the cover 32. For example, one possible set of position ranges that may be employed with cover 32 could include any one of a fully covering position, a substantially lifted (parallel) covering position, a lifted and rotated (angled) covering position, or a non-covering (partially or fully stowed) position.

As clearly shown in FIGS. 3A through 6, the hinge portions of the slotted hinge assembly 34, including the first hinge members 40 and the second hinge members 50. The first hinge members are coupled or fixed to the cover proximate to the second edge 32*b*, and are preferably spaced apart from each other. The second hinge members 50 are fixed to (e.g., mounted upon) a selected and substantially vertical (side) wall 24*b* of the housing 24. Typically a preferred vertical wall 24*b* of the housing 24 may be the rear wall of the housing. In addition, the fastening and mounting of the slotted hinge assembly 34 is such that all portions of the cover and slotted hinge assembly 30 may be rotated and stowed so as to be completely located below a plane 28 established by the (top) windowed housing surface 24*a* (containing the imaging window 26). See FIGS. 5, 6, and 7.

Figure 6:
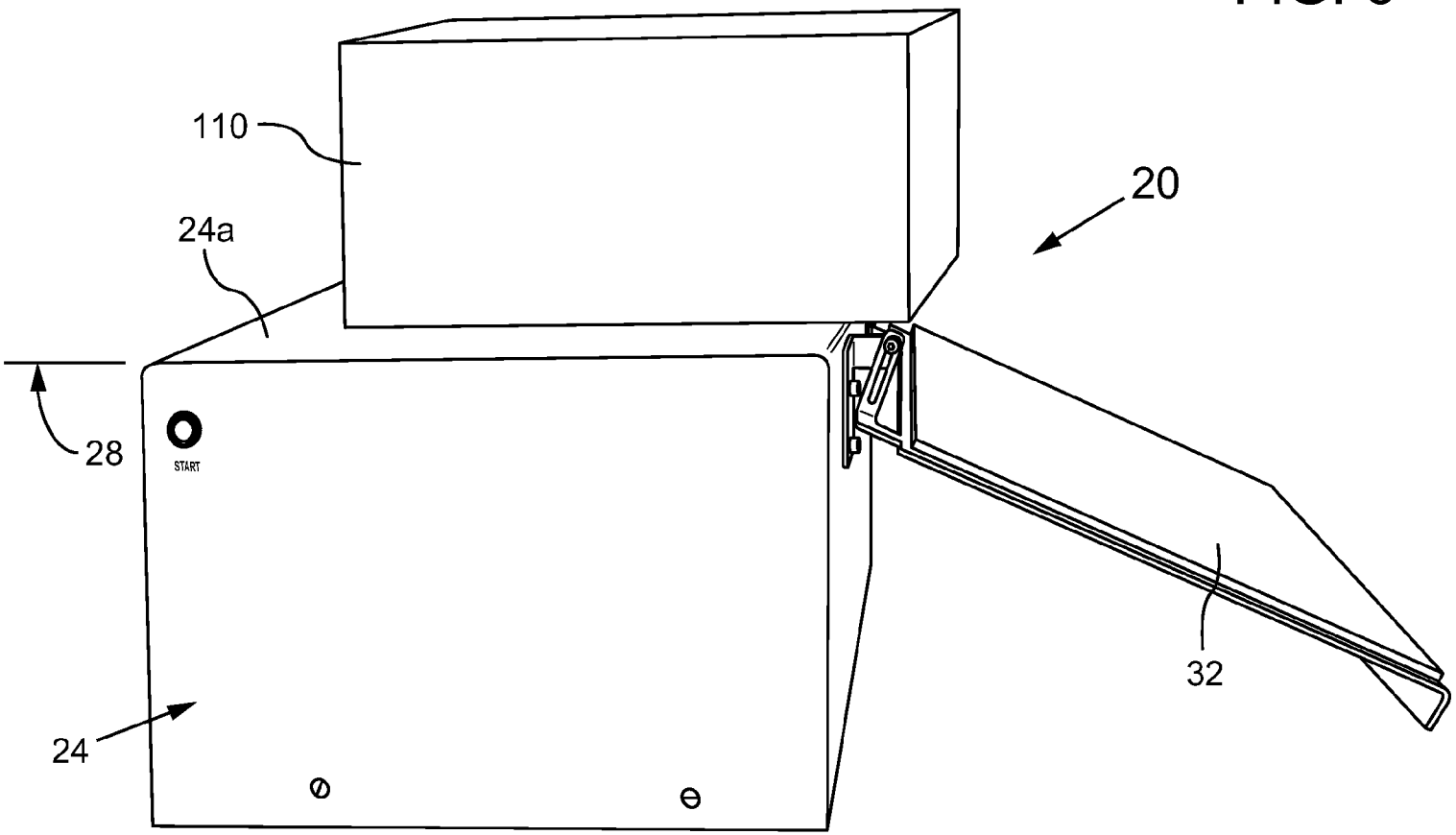
FIG. 6 depicts the cover in what will be termed a rotated and stowed position, such that the cover is located behind the housing, and as shown below a plane established by a top windowed housing surface (containing the imaging window).

Importantly, when the cover 32 is fully rotated and stowed, the imaging apparatus 20 can readily accommodate large box-like packages. For example, as illustrated in FIG. 6, once the cover 32 has been at least partially stowed, a data carrying graphical symbol located upon a surface of the depicted large package 110 may be placed flatly upon a (top) windowed housing surface 24*a* and over the imaging window 26 of the imaging apparatus 20. That is, the box 110 of FIG. 6 may be positioned so that a data carrying graphical symbol (not visible in FIG. 6) may be imaged through the imaging window 26—even with a package that is larger than the imaging apparatus itself.

As such, due to the flexible, functional, and unique structure of the cover and slotted hinge assembly 30, the lifting, rotating, and or stowing of the cover 32 of the cover and slotted hinge assembly 20 is specifically and fully supported—while never having to separate the cover 32 from the imaging apparatus 20. This completely eliminates the possibility of the cover being misplaced or lost!

Figure 4:
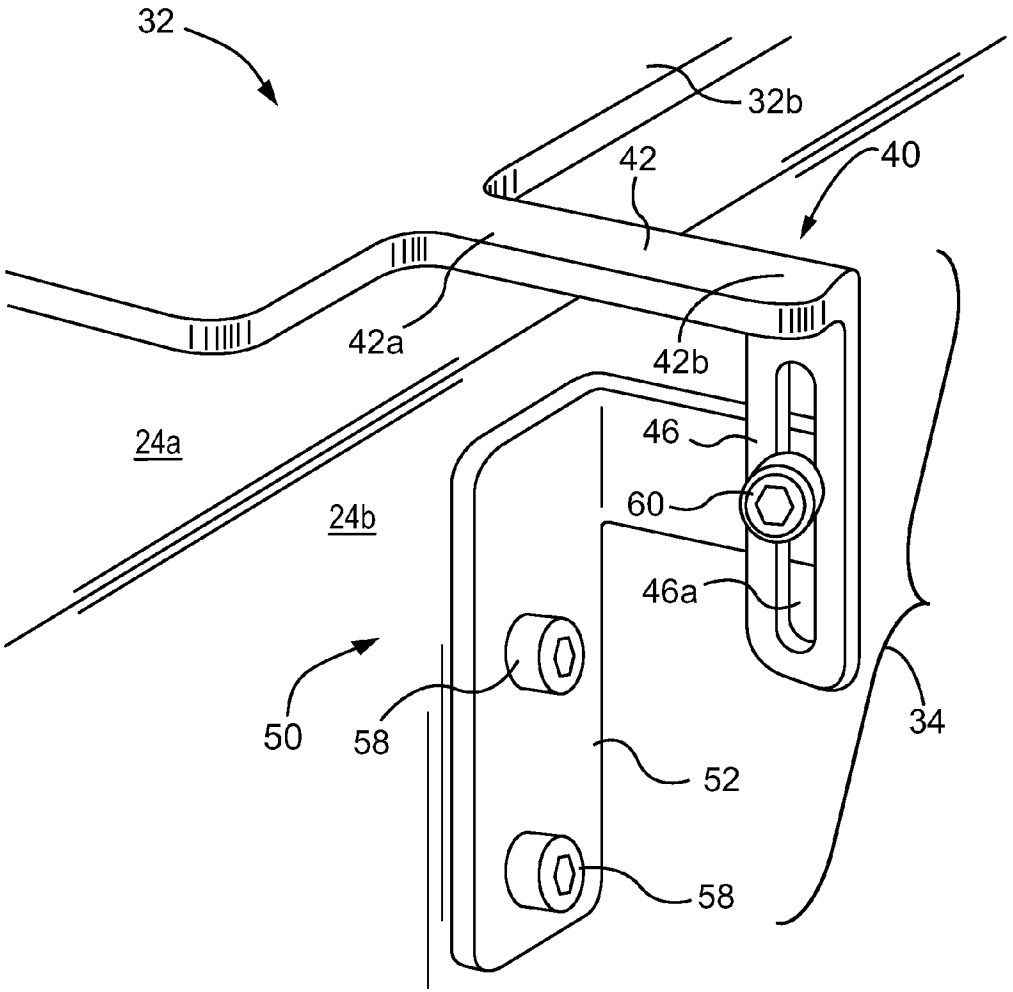
FIG. 4 illustrates an enlarged view of a preferred embodiment of a slotted hinge assembly of the invention.

Turning now to FIG. 4, an enlarged view of a preferred embodiment of a slotted hinge assembly 34 of the cover and slotted hinge assembly 30 is illustrated with a partially shown cover 32. The first hinge member 40 is preferably structured with an extending first portion 42 that rigidly and fixedly extends from a second edge 32*b* of the cover 32. Accordingly, each included extending first portion 42 preferably extends outwardly from the second edge 32*b*, and is preferably substantially physically located in a plane of the cover 32. Proximate to the distal end 42*b* of the extending first portion 42, a slotted second portion is coupled, possibly in a rigid fashion and arranged with a slot 46*a* that is oriented somewhat or substantially orthogonally to the depicted extending first portion, along with a plane occupied by the cover 32 and the extending first portion 42. It may be noted that non-rigid coupling arrangements are certainly contemplated for coupling the distal end 42*b* of the extending first portion 42 to the slotted second portion 46.

The included slot 46*a* will therefore enable the cover 32 to be lifted in the parallel lifting manner, enabling items having a range thicknesses to be covered in either a fully covering position or a lifted parallel covering position. That is, this slotted structure, as clearly shown in FIG. 4, will enable the cover 32 to cover items that are paper thin, as well as considerably thicker items, such as the book depicted in FIG. 5.

Figure 3A:
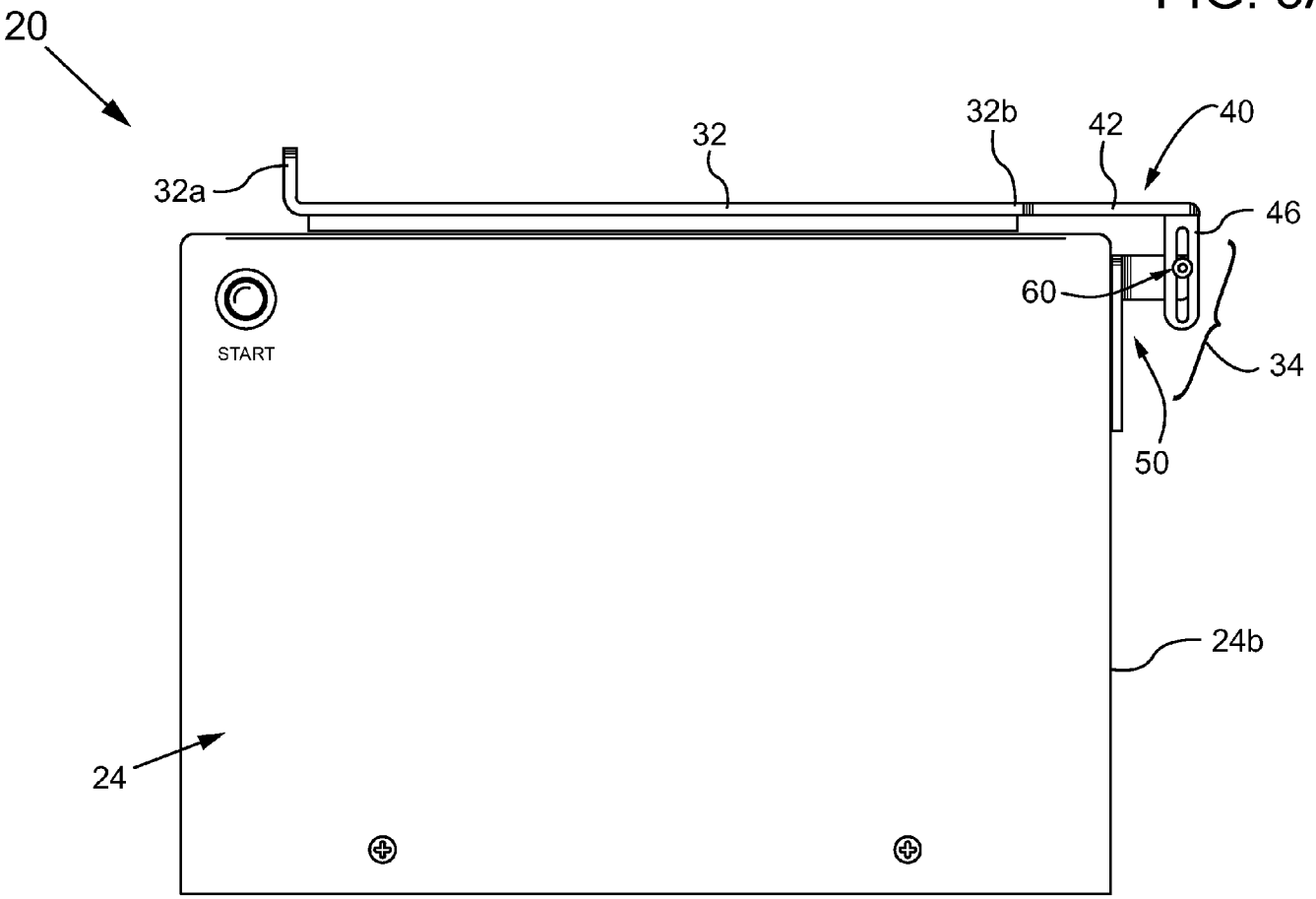
FIG. 3A provides a side (profile) view of the imaging housing of FIGS. 1 and 2, with the cover and a slotted hinge assembly depicted in what may be termed a fully covering position.
Figure 3B:
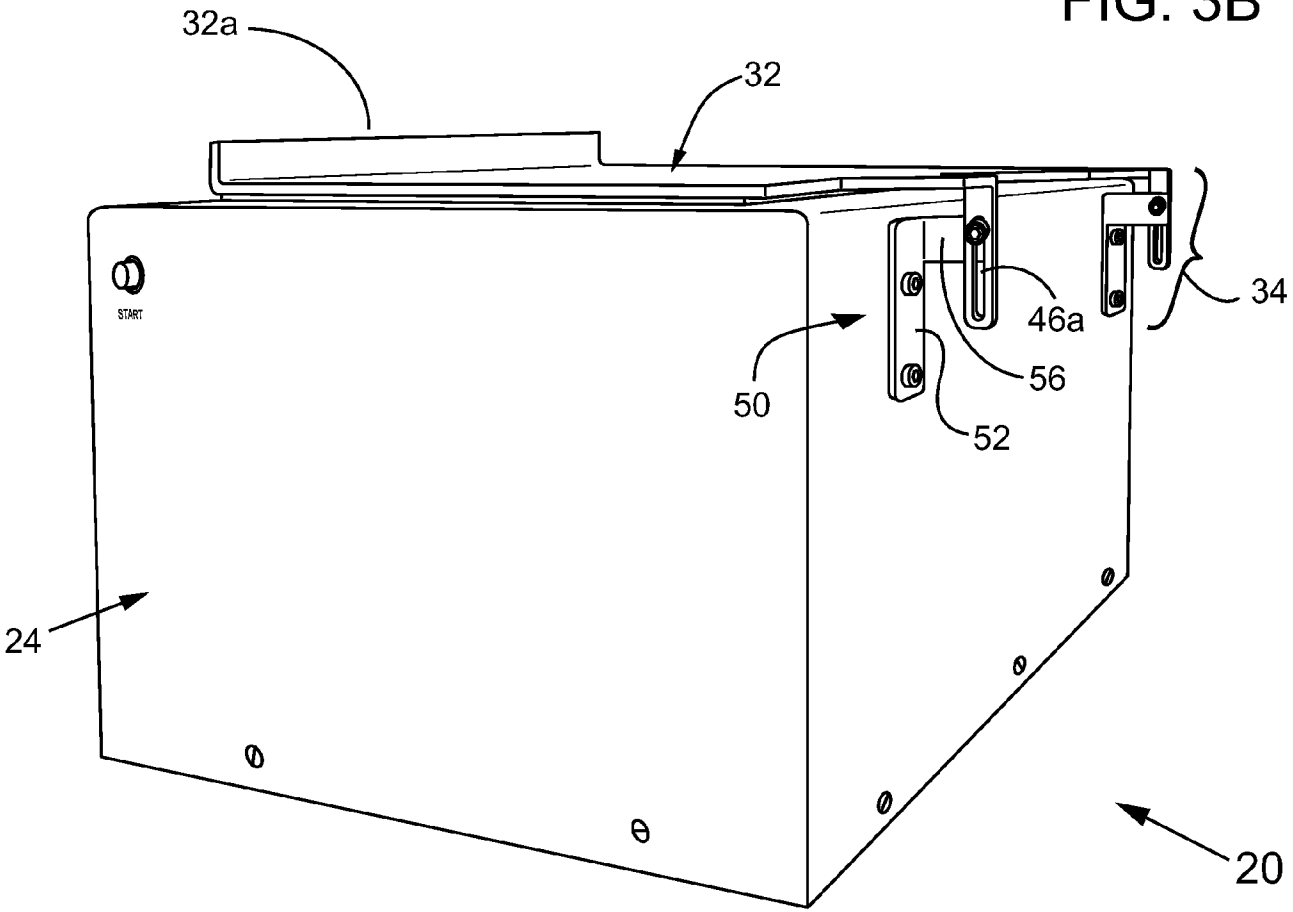
FIG. 3B illustrates the imaging apparatus of FIG. 3A, but now providing a more rear-ward perspective view of the imaging housing, clearly showing a (rear) vertical wall and the two spaced slotted hinge assemblies included with this embodiment.

As explicitly depicted in the included figures, and as possibly best seen in FIGS. 3A, 3B, and 4, the cover and each of the included first hinge members 40 may be formed of a single monolithic piece of sheet material. This construction approach means that the cover 32 and the first hinge member 40 may be clearly formed from (e.g., stamped out of) a single common piece of sheet material. In a most preferred embodiment the sheet material is aluminum or another light and rigid material. In a most simple and possibly most preferred embodiment of the cover and slotted hinge assembly 30 the coupling between the extending first portion 42 and the slotted second portion 46 may be realized by a one-piece construction, with a single bend in the material of substantially 90 degrees (for each included slotted second portion). Alternately, these portions may be coupled by being welded, or may even be cast.

Returning to FIG. 4, for each included first hinge member 40 there is a matching and properly aligned second hinge member 50. The possibly most preferred embodiments of the second hinge member 50, as illustrated in the included figures, may be structured having a fixing portion 52 and a coupling portion 56. The fixing portion 52 enables each second hinge member 50 to be fixed proximate to an upper location of a vertical wall 24*b* of the housing 24. The coupling portion 56 of each second hinge member 50, as clearly shown in FIGS. 3B and 4, may be arranged for extending away from the rear upper wall of the housing 24, enabling the coupling portion 56 to be to a slotted second portion 46 of each included first hinge member 40. Importantly, this rotatable and slideable coupling is specifically provided at a selected distance from the rear side wall of the housing. For example, a preferred selected distance from the vertical wall 24*b* to the hinge pin 60, may preferably be in the range of 0.5 to 2 inches. The actual distance desired may be best determined by the size of the housing 24 of the imaging apparatus 20.

Returning again to FIG. 4, if each second hinge member 50 is manufactured from a single piece of material (as illustrated), the second hinge members 50 may most preferably be formed of an (unbalanced) L-shaped piece of sheet material, with a substantially 90 degree bend provided where the fixing portion 52 is fixedly coupled to the coupling portion 56. Accordingly, each second hinge members 50 may be provided by a single piece of sheet material, with a single substantially 90 degree bend provided therein. It is fully contemplated that each of the cover 32, first hinge members 40 and second hinge members 50 may all be preferably produced (fabricated) of a sheet material having a common selected thickness. The actual thickness selected may again be best determined as a function of the size of the cover 32 and the housing 24, and possibly by the weight required of the cover to hold flexible/wrinkled substrates flatly to the imaging window. A preferred thickness may be in the range of ⅛" to ¼" thick.

Figure 5:
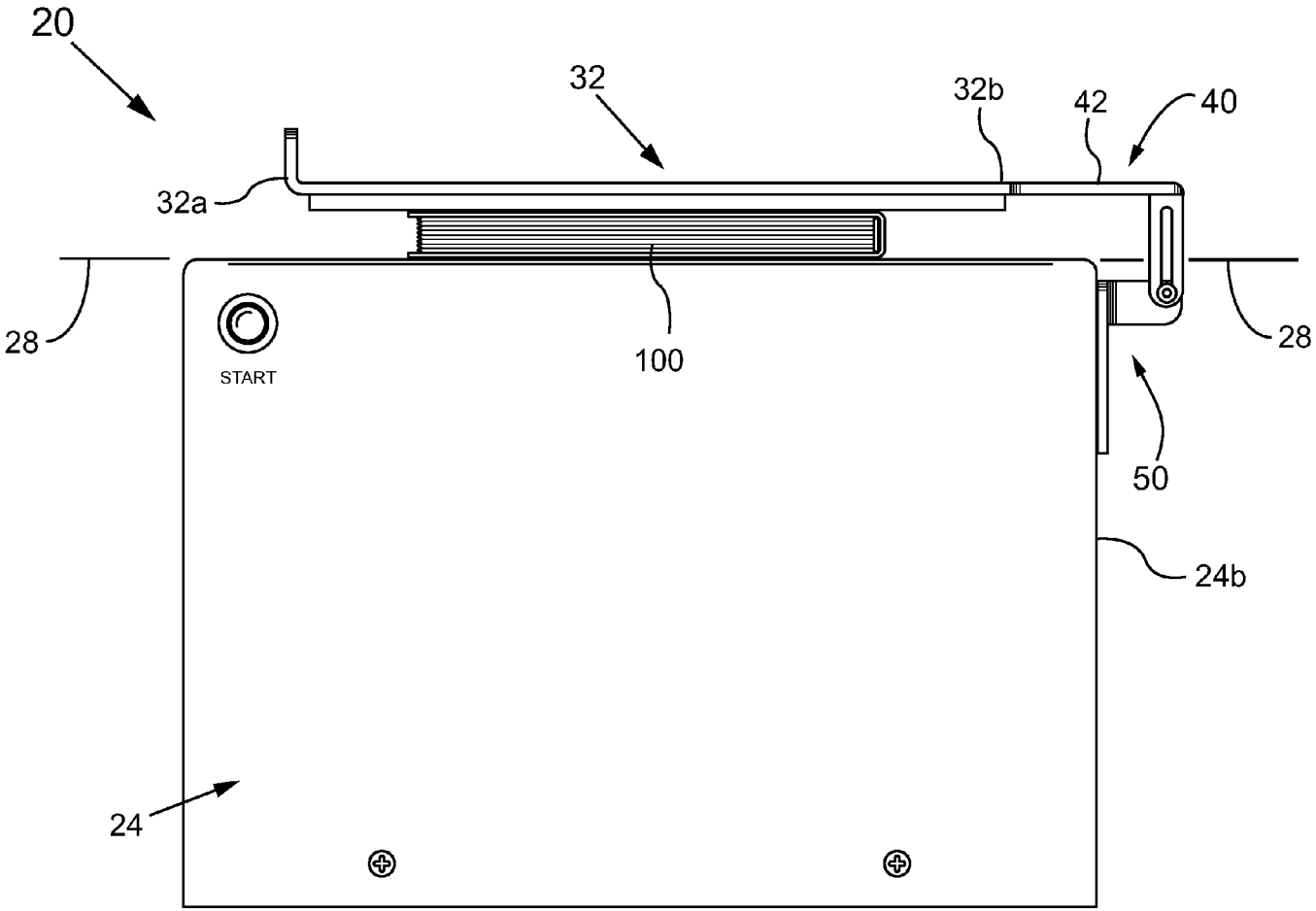
FIG. 5 shows a side (profile) view of an imaging housing, with the cover in an lifted parallel covering position, covering what may be assumed be a book with a data carrying graphical symbol printed on an outer and lower surface (as depicted).
Figure 7:
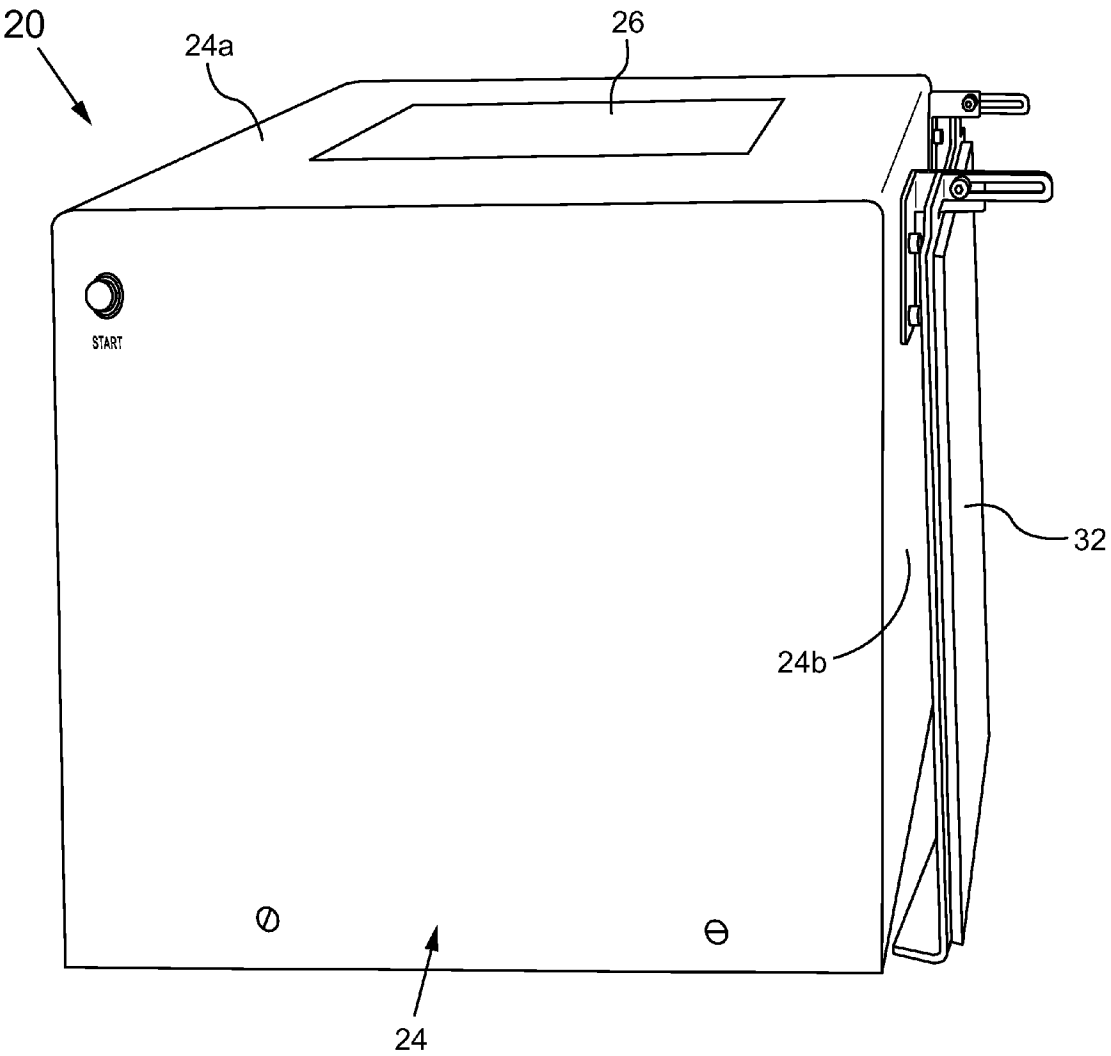
FIG. 7 depicts a fully rotated and stowed cover, which is positioned substantially parallel to the rear wall of the housing assembly in a non-covering position.

As clearly illustrated and possibly best seen in FIGS. 4, each first hinge member 40 and second hinge member 50 are rotatably and slideably coupled by an included (capped) hinge pin 60. As shown, the provided structure of the slotted hinge assembly 34 enables the cover 32 to be placed in a variety of covering positions based on how much the cover is lifted (via slot 46*a*) and how much the cover is rotated (via hinge pin 60). For example, common and likely covering positions may include:

a) a fully covering position, wherein a paper-thin item may be fully covered by the cover 32 (as shown in FIG. 1);

b) a lifted parallel covering position, wherein an item like a ½" thick book may be readily (parallel) covered (as shown in FIG. 5);

c) a partially lifted and partially rotated position, wherein an item with a considerable thickness (e.g., 6 inches thick) may be partially "covered" so that a portion of the ambient light may be blocked (as depicted in FIG. 2, without the 6" thick item explicitly shown);

d) a non-covering partially rotated and stowed position (say about 180 degrees from the fully covering position, as shown in FIG. 6); or e) a fully rotated and stowed position (as shown in FIG. 7).

While there have been described herein a plurality of the currently preferred embodiments of the means and methods of the present invention, those skilled in the art will recognize that other and further modifications may be made without departing from the invention. For example, the relative dimensions and lengths of items such as the extending first portion 42, the slotted second portion 46, the coupling portion 56, etc., may actually be considerably shorter or longer than currently depicted. It should also be noted that alternate hinging arrangements are certainly possible. For example, embodiments are contemplated that are structured having a second hinge pin and rotational-joint where the distal end of the extending first portion 42 is coupled to the slotted second portion 46 (not explicitly illustrated). With this alternate "dual hinge-pin version" of the first hinge members 40, two rotational couplings would be provided, possibly supported by a more discrete second slotted portion structured as a linear member having a hole provided proximate to a first end and a slot provided proximate to a second end (not explicitly depicted).

In addition, to the above possible modifications, a cover and slotted hinge assembly may certainly include more that the two presently illustrated slotted hinge assemblies 34. For example, three or four such assembly may be required, possibly based on the size and weight of the cover 32. Accordingly, the foregoing descriptions of the specific embodiments of the present invention have been provided for the purposes of illustration, description, and enablement. They are not intended to be exhaustive or to limit the invention to the specific forms disclosed and or illustrated. Obviously numerous modifications and alterations are possible in light of the above teachings, and it is fully intended to claim all modifications and variations that fall within the scope of the appended claims provided hereinafter.

What is claimed is:

1. A cover and slotted hinge assembly, comprising:

a) a cover structured with a first edge and a second edge;

b) a plurality of spaced first hinge members, coupled to the cover proximate to the second edge;

c) with each first hinge member including:

i) an extending first portion that extends from the second edge of the cover so as to extend outwardly from the second edge; and ii) a slotted second portion coupled to a distal end of the extending first portion;

d) a matching plurality of spaced and aligned second hinge members that are fixedly coupled to an upper location of a rear side wall of a housing, and rotatably and slideably coupled to aligned first hinge members via the slotted second portions thereof;

e) with the cover and slotted hinge assembly structured for enabling the cover to remain fully attached to the imaging apparatus housing while being placed in any of a fully covering position, a lifted parallel covering position, a partially lifted and rotated position, or a non-covering rotated and stowed position;

f) wherein the cover and each of the included first hinge members are at least one of:

a) formed of a single piece of sheet material; and b) each arranged to be substantially within a common plane.

2. The cover and slotted hinge assembly in accordance with claim 1, wherein a single, rigid, and substantially 90 degree bend is provided between the extending first portion and the slotted second portion.

3. The cover and slotted hinge assembly in accordance with claim 1, wherein the second hinge member is comprised of:

a) a fixing portion for fastening to an upper location of a vertical wall portion of the housing; and b) a coupling portion structured for being rotatably and slideably coupled to a slotted second portion of an included and aligned first hinge member.

4. The cover and slotted hinge assembly in accordance with claim 3, wherein the second hinge member is formed of an L-shaped piece of sheet material, with rigid and a substantially 90 degree bend added between the fixing portion and the coupling portion.

5. A cover and slotted hinge assembly for use in selectively covering an imaging window of a housing of an imaging apparatus, with the cover and slotted hinge assembly enabling an imaging of printed matter present upon items of varying sizes, shapes, and thicknesses, with the cover and slotted hinge assembly comprising:

a) a substantially planar cover arranged with a first edge and a second edge;

b) at least two spaced first hinge members coupled to the cover, wherein each first hinge member includes an extending first portion rigidly coupled to the cover proximate to the second edge, and a slotted second portion coupled to a distal end of the extending first portion at a substantially orthogonal angle;

c) at least two spaced second hinge members, with each second hinge member structured having:

i) a fixing portion for fixing to an upper vertical wall of the housing; and ii) a coupling portion for being rotatably and slideably coupled to the slotted second portion of each aligned first hinge member;

d) with the second hinge members, and the rotatable and slidable coupling to the first hinge members, thereby enabling a positioning of the cover in a range of positions including:

i) over an imaging window of the housing in a full covering position;

ii) over the imaging window in a lifted parallel covering position;

iii) in an elevated and rotated covering position, wherein the cover is still located above a plane of a imaging window; or iv) in a rotated non-covering stowed position, with the cover fully located below the plane of the imaging window, wherein a large object can be placed over the imaging window, fully covering the imaging window, without contacting the cover and slotted hinge assembly.

6. The cover and slotted hinge assembly in accordance with claim 5, wherein the cover and the extending first portion, are each substantially in a common plane.

7. The cover and slotted hinge assembly in accordance with claim 6, wherein the cover, the extending first portion and slotted second portion are formed of a monolithic piece of sheet material, with a single right angle bend provided between the distal end of the extending first portion and slotted second portion of each first hinge member.

8. The cover and slotted hinge assembly in accordance with claim 7, wherein the monolithic piece sheet material is aluminum sheet material.

9. The cover and slotted hinge assembly in accordance with claim 5, wherein the second hinge member is comprised of:

a) a fixing portion for fastening to an upper location of a vertical wall portion of the housing; and b) a coupling portion structured for being rotatably and slideably coupled to a slotted second portion of an included and aligned first hinge member.

10. The cover and slotted hinge assembly in accordance with claim 9, wherein a second hinge member if provided by a monolithic piece of sheet material having a single substantially 90 degree bend is provided between the fixing portion and the coupling portion.

11. A cover and slotted hinge assembly for use covering an imaging window of a housing of an imaging and print quality verifier apparatus, with the cover and slotted hinge assembly comprising:

a) at least two second hinge members, which are spaced and fixedly coupled to an upper location of a vertical wall of a housing of the imaging and print quality verifier apparatus;

b) a cover having a first edge and an opposite second edge;

c) at least two spaced first hinge members rigidly coupled to and extending from the second edge of the cover, with each first hinge member structured for being rotateably coupled to an included and aligned second hinge member;

d) with each first hinge member including a downwardly oriented slotted second portion that is spaced away from the cover;

e) a coupling structure for enabling a coupling of each first hinge member to a respective and aligned second hinge member, wherein the coupling structure enables each included first hinge member to be rotatably and slideably coupled to an included and aligned second hinge member, enabling the cover to be placed in one of:

i) a fully covering position;

ii) a lifted parallel covering positioning;

iii) a rotated, lifted, and partial covering position; or iv) a fully rotated and stowed position, wherein the entire cover and slotted hinge assembly are fully located below a plane established by the imaging window of the imaging apparatus housing.

12. The cover and slotted hinge assembly in accordance with claim 11, wherein the cover is formed of a substantially planar sheet material having a substantially rectangular shape, with additional spaced sheet portions extending from a second edge of the cover for providing an extending first portion to which the downwardly oriented slotted second portions are coupled.

13. The cover and slotted hinge assembly in accordance with claim 12, wherein the cover, the extending first portion, and slotted second portion of each first hinge member are formed of a monolithic piece of rigid sheet material, with a single right angle bend provided between a distal end of the extending first portion and the slotted second portion.

* * * * *